United States Patent [19]

Skinner

[11] 4,280,454

[45] Jul. 28, 1981

[54] ENGINE INSTALLATIONS

[75] Inventor: Robert T. J. Skinner, High Wycombe, England

[73] Assignee: Lucas Industries Limited, Birmingham, England

[21] Appl. No.: 53,237

[22] Filed: Jun. 29, 1979

[30] Foreign Application Priority Data

Jul. 18, 1978 [GB] United Kingdom ..... 30196/78

[51] Int. Cl.[3] ..... F02F 7/00

[52] U.S. Cl. ..... 123/195 A; 123/509

[58] Field of Search ..... 123/195 A, 509

[56] References Cited

U.S. PATENT DOCUMENTS 4,007,723 2/1977 Laughton ..... 123/195 A

OTHER PUBLICATIONS

GM Maintenance Manual, pp. 99–100, FIG. 86, Pub. Date–1942.

*Primary Examiner*—Ronald B. Cox

[57] ABSTRACT

An engine installation includes an engine casing, an engine ancillary having a mounting flange and a plate. The flange has arcuate apertures spaced about the axis of a drive shaft to receive securing bolts to secure the flange and plate to the casing. The plate has complementary apertures of circular section and means is provided to secure the plate to the flange once the ancillary has been correctly positioned on the casing, whereby the plate and ancillary can be removed from and reassembled to the engine casing without disturbing the angular setting of the ancillary on the casing.

4 Claims, 4 Drawing Figures

ENGINE INSTALLATIONS

This invention relates to an engine installation including an engine casing, an engine ancillary which includes a shaft driven in timed relationship with the engine by driving means within the casing and means mounting the ancillary on the casing.

An example of such an ancillary is the fuel injection pump fitted to a compression ignition engine. The position of the body of the pump about the axis of rotation of its drive shaft is critical since it determines the timing of fuel delivery to the engine by the pump. It is a requirement in some countries that once the timing of the pump relative to the engine has been set then it must not be capable of alteration by unauthorised persons. The pump should be capable of removal from the engine for minor servicing and subsequent reassembly on the engine without disturbing the timing and the object of the present invention is to provide an engine installation of the kind specified in a form in which this can be achieved.

According to this invention in an engine installation of the kind specified, the engine ancillary is provided with a mounting flange having formed therein an arcuate aperture spaced from the axis of rotation of the shaft, a mounting plate for location against the said flange, a circular aperture formed in the mounting plate at a position to register with said arcuate aperture, said apertures in use receiving a cylindrical element whereby the flange and plate can be secured to the engine casing and means for fastening said plate to said flange once the ancillary has been correctly positioned on the engine casing whereby the ancillary and the plate can be detached from the casing and reassembled thereto, the aperture in the plate ensuring that the ancillary and plate are reassembled to the casing in the correct position.

Figure 1:
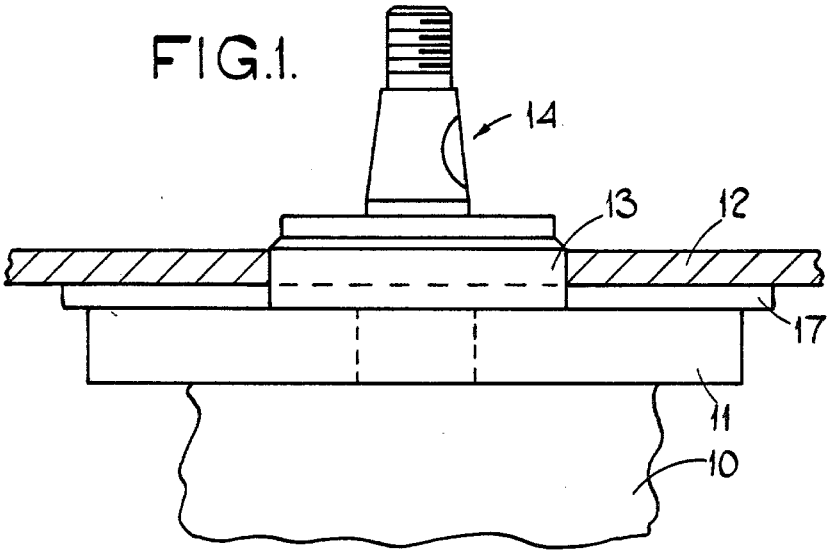
Figure 2:
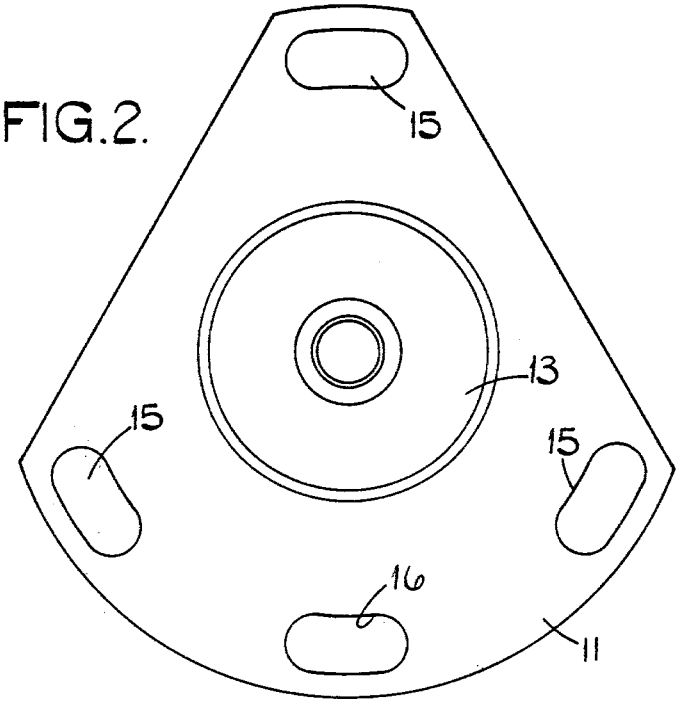
Figure 3:
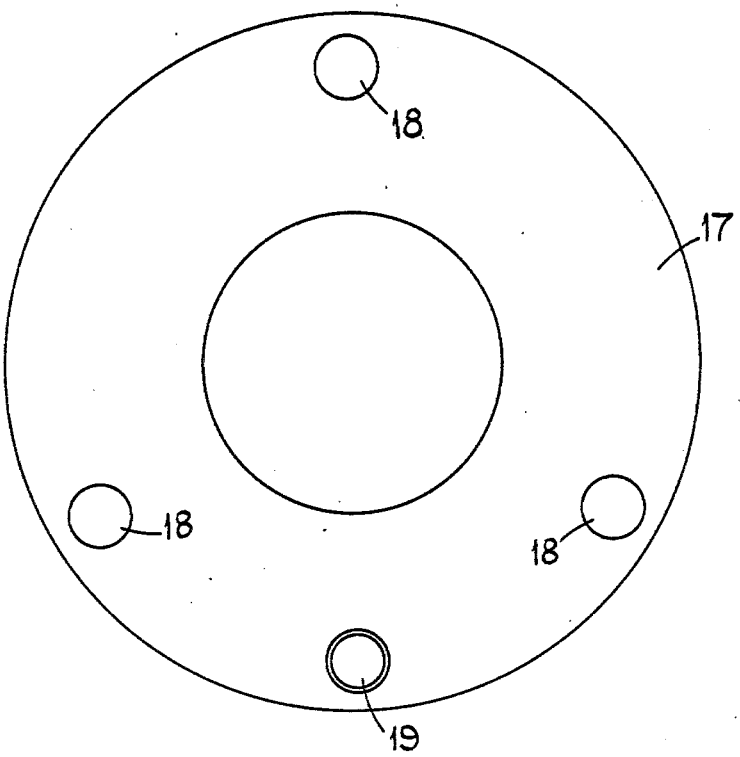
Figure 4:
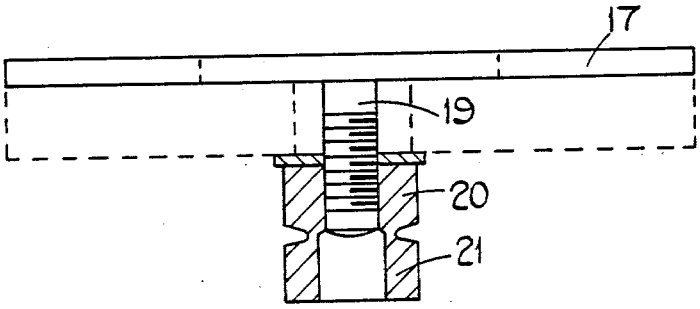

One example of an engine installation in accordance with the invention will now be described with reference to the accompanying drawings in which:

FIG. 1 is a plan view of a pumping apparatus shown installed to an engine casing, FIG. 2 is an end view of the pumping apparatus, FIG. 3 is a view similar to FIG. 2 of a mounting plate and, FIG. 4 is an inverted plan view of the mounting plate.

Referring to FIG. 1 of the drawings, the pumping apparatus includes a pump body 10 having at one end a flange 11 whereby the apparatus can be secured to the casing indicated at 12 of an engine. The body 10 of the apparatus defines a spigot portion 13 through wich extends a drive shaft 14.

In use, the drive shaft is connected by a spline connection to a driven member within the engine casing, the spline being so constructed that it can ony be connected to the driven member at one relative angular setting.

As seen in FIG. 2 the flange 11 is provided with three apertures 15 in a triangular configuration. Each aperture 15 is of arcuate form. The flange is also provided with an additional arcuate aperture 16.

Referring now to FIG. 3 there is shown a mounting plate 17 which in use, and as shown in FIG. 1 is positioned between the flange and the casing 12 of the engine. The central aperture in the mounting plate is of a size so that the spigot 13 can pass therethrough. The mounting plate is provided with three circular apertures 18 in a triangular configuration corresponding to the apertures 15. In addition, the mounting plate is provided with a stud 19 on the face thereof which in use is presented to the flange. The stud 19 is screw threaded and is positioned so that it can pass through the aperture 16.

The casing 12 of the engine may be provided with three mounting studs which can pass through the apertures 18 and 15 or alternatively, the casing will be provided with three tapped holes at the same positions, for the reception of threaded bolts.

When the pump is assembled to the engine the mounting plate and flange are loosely held in position by the aforesaid studs or bolts and the angular position of the body of the apparatus is adjusted until the correct position is obtained. The extent of angular adjustment which can be obtained is determined by the arcuate length of the apertures 15 and 16. When the correct setting has been achieved the flange and mounting plate are firmly secured to the casing of the engine either by the bolts or by affixing nuts to the studs. When thus attached a shear nut having a round portion 20 and a severable portion 21 is engaged with the stud and it is tightened onto the stud until the two portions shear. The mounting plate 17 is thus firmly fastened to the flange and cannot be removed or the angular setting thereof altered unless a special tool is utilised to remove the plane cylindrical portion 20 of the shear nut. The flange and mounting plate may however, be removed from the casing of the engine and when replaced the same angular setting is achieved. This is because the apertures 18 in the mounting plate co-operate with the studs or bolts to prevent angular adjustment.

I claim:

1. An engine installation including an engine casing, an engine ancillary including a shaft driven in use, in timed relationship with the engine by driving means within the engine casing and means mounting the ancillary on the casing, said means comprising a mounting flange on the engine ancillary, said mounting flange having formed therein an arcuate aperture spaced from the axis of rotation of the shaft, a mounting plate for location against the said flange, a circular aperture formed in the mounting plate at a position to register with said arcuate aperture, securing means for securing the mounting flange and the mounting plate to the engine casing, said securing means including a cylindrical element passing through said apertures, and means for fastening said plate to said flange once the ancillary has been correctly positioned on the engine casing whereby the ancillary and the plate can be detached from the casing and reassembled thereto, the aperture in the plate ensuring that the ancillary and plate are reassembled to the casing in the correct position.

2. An engine installation according to claim 1 in which the mounting flange is provided with a plurality of said arcuate apertures and the mounting plate with a corresponding number of circular apertures.

3. An engine installation according to claim 1, or claim 2 in which the means for fastening said plate to said flange comprises a stud mounted on said plate, a further arcuate aperture in the flange through which said stud extends when the plate and flange are in assembled relationship, and means engageable with said stud to secure the plate and flange relative to each other.

4. An engine installation according to claim 3 in which the means engageable with said stud comprising a sheer nut having a cylindrical portion which is in screw thread engagement with the stud and a severable portion which is severed from the cylindrical portion when the nut is tightened.

* * * * *